US010662010B2

(12) United States Patent
Murakami et al.

(10) Patent No.: US 10,662,010 B2
(45) Date of Patent: May 26, 2020

(54) SHEET FEEDING DEVICE, IMAGE FORMING APPARATUS, AND METHOD FOR SHEET FEEDING DEVICE

(71) Applicant: CANON KABUSHIKI KAISHA, Tokyo (JP)

(72) Inventors: Atsushi Murakami, Kawasaki (JP); Tomoya Tateishi, Kamakura (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/217,644

(22) Filed: Dec. 12, 2018

(65) Prior Publication Data

US 2019/0193964 A1 Jun. 27, 2019

(30) Foreign Application Priority Data

Dec. 27, 2017 (JP) ..... 2017-252539

(51) Int. Cl.

| | |
|---|---|
| ***B65H 3/06*** | (2006.01) |
| ***B65H 3/56*** | (2006.01) |
| ***B65H 1/24*** | (2006.01) |
| ***B65H 3/68*** | (2006.01) |
| ***B65H 3/52*** | (2006.01) |

(52) U.S. Cl.

CPC ..... *B65H 3/565* (2013.01); *B65H 1/24* (2013.01); *B65H 3/06* (2013.01); *B65H 3/0669* (2013.01); *B65H 3/0684* (2013.01); *B65H 3/5215* (2013.01); *B65H 3/68* (2013.01); *B65H 2403/422* (2013.01)

(58) Field of Classification Search

CPC . B65H 3/565; B65H 1/24; B65H 3/06; B65H 3/0669; B65H 3/0684; B65H 3/5215; B65H 3/68; B65H 2403/422

See application file for complete search history.

(56) References Cited

U.S. PATENT DOCUMENTS

2005/0017434 A1* 1/2005 Yamanaka ..... B41J 13/103 271/122
2018/0222224 A1* 8/2018 Jariabka ..... B65H 3/06

FOREIGN PATENT DOCUMENTS

| | | | |
|---|---|---|---|
| JP | 2-66533 | U | 5/1990 |
| JP | 200326349 | A | 1/2003 |
| JP | 2007145535 | A | 6/2007 |
| JP | 200996574 | A | 5/2009 |

* cited by examiner

*Primary Examiner* — David H Bollinger

(74) *Attorney, Agent, or Firm* — Canon U.S.A., Inc. IP Division

(57) ABSTRACT

A sheet feeding device includes a sheet stacking unit to stack a plurality of sheets, a feeding unit to feed sheets stacked on the sheet stacking unit, a separation unit, and a moving unit provided with at least a first moving member and a second moving member. The separation unit contacts the sheets fed by the feeding unit and separates a sheet from the sheets. The moving unit contacts the first and the second moving members to move a sheet contacting the first and the second moving members to an upstream side in a feeding direction. A leading edge of the sheet is positioned between the separation unit and the feeding unit. When pressed by the sheet, the first and the second moving members are configured to thrust-move independently of each other.

11 Claims, 16 Drawing Sheets

WAITING STATE

SHEET-PASSING STATE

RETURNING STATE

SHEET FEEDING DEVICE, IMAGE FORMING APPARATUS, AND METHOD FOR SHEET FEEDING DEVICE

BACKGROUND OF THE INVENTION

Field of the Invention

The present disclosure relates to a sheet feeding device, an image forming apparatus, and a method for the sheet feeding device.

Description of the Related Art

Some sheet feeding devices for feeding a sheet include a separation mechanism for separating a plurality of stacked sheets, and a mechanism for preventing double feed.

In a separation roller system as a separation mechanism, a separation roller to be in pressure-contact with a feed roller is provided with a torque limiter, and a sheet is separated by the resistance generated by the torque limiter and a coefficient of friction of the separation roller. As a mechanism for preventing double feed, a system discussed in Japanese Patent Application Laid-Open No. 2003-26349 is provided with a moving unit including return levers as moving members. For each sheet conveyance, the system operates the return levers to move back a sheet leading edge to a predetermined position.

The configuration discussed in Japanese Patent Application Laid-Open No. 2003-26349 is provided with a plurality of moving members in a width direction as the moving unit. If the moving member on one side is depressed because of the deformation (such as a curl and undulation) in the sheet width direction, the moving member on the other side may be retracted in an associative way. In this case, the return operation will be performed only by the moving member on one side, possibly moving back the sheet in an oblique way.

SUMMARY OF THE INVENTION

The present disclosure is directed to a sheet feeding device and an image forming apparatus that stably moves (back) a sheet in a configuration including a moving unit.

According to an aspect of the disclosure, a sheet feeding device includes a sheet stacking unit configured to stack a plurality of sheets, a feeding unit configured to feed sheets stacked on the sheet stacking unit, a separation unit configured to contact the sheets fed by the feeding unit and separate a sheet from the sheets, and a moving unit provided with at least a first moving member and a second moving member and configured to contact the first and the second moving members to move a sheet contacting the first and the second moving members to an upstream side in a feeding direction, wherein a leading edge of the sheet is positioned between the separation unit and the feeding unit, wherein, when pressed by the sheet, the first and the second moving members are configured to thrust-move independently of each other.

Further features of the present disclosure will become apparent from the following description of embodiments with reference to the attached drawings.

DESCRIPTION OF THE EMBODIMENTS

A first embodiment of the present disclosure will be described below with reference to the accompanying drawings. The first embodiment will be described below centering on a laser beam printer as an example of an image forming apparatus which sequentially transfers toner images of respective colors from photosensitive drums to a belt and then collectively transfers the toner images on the belt to a sheet. However, sizes, materials, shapes, and relative arrangements of elements described in the present embodiment are not limited thereto and are to be modified as required depending on a configuration of an apparatus according to the present disclosure and other various conditions. The scope of the present disclosure is not limited to the embodiments described below.

<Overall Configuration of Image Forming Apparatus>

Figure 1:
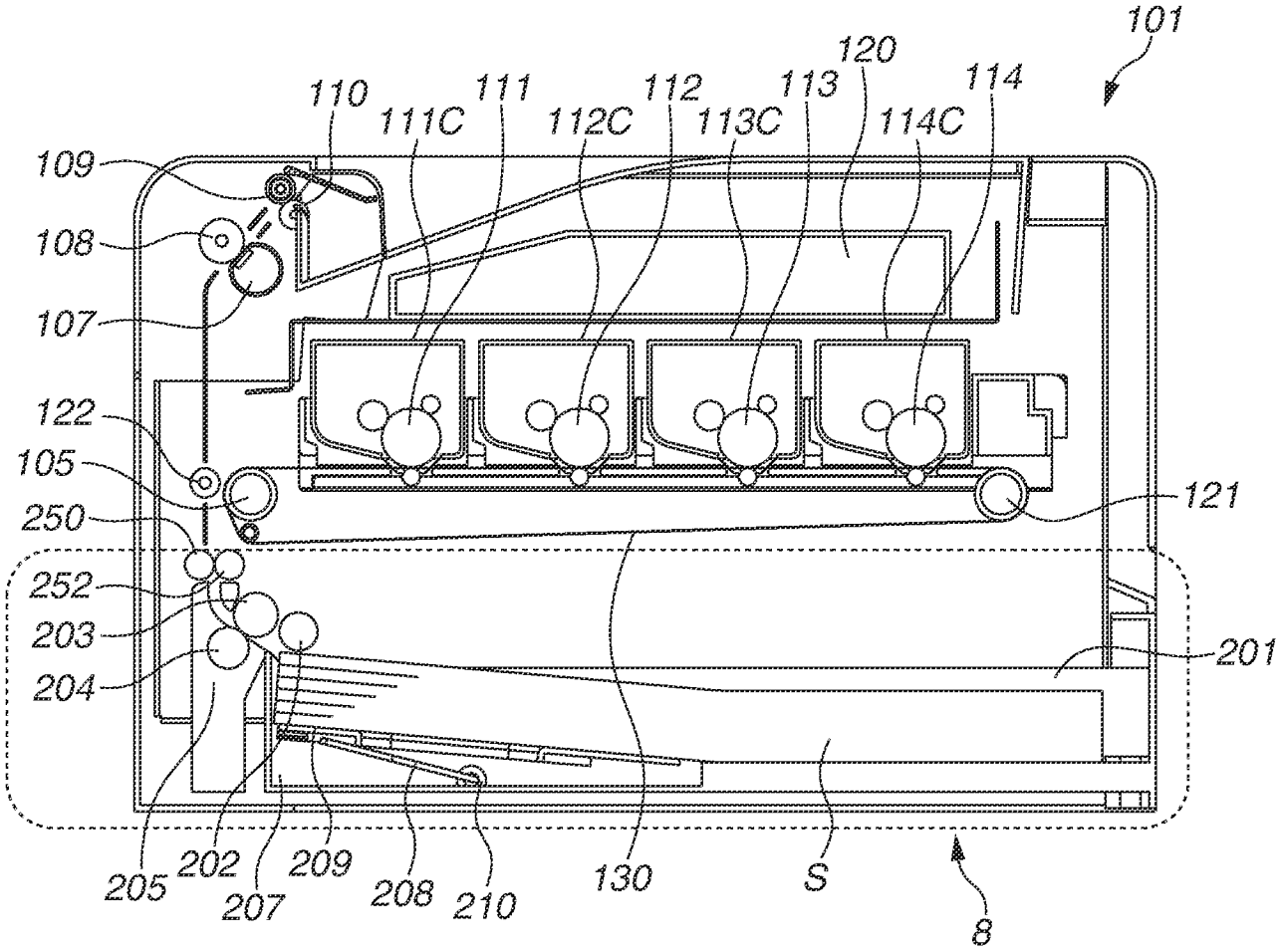
FIG. 1 is a cross-sectional view illustrating an image forming apparatus.

An overall configuration of an image forming apparatus 101 will be described below with reference to FIG. 1. FIG. 1 is a cross-sectional view schematically illustrating a configuration of the image forming apparatus 101. Sheets S stacked in a feeding cassette 201 included in a sheet feeding device 8 is fed by a feeding roller (first feeding member) 202 rotating in a clockwise direction illustrated in FIG. 1. A sheet S fed is sent to a conveyance nip portion formed by a feed roller 203 and a conveyance facing roller 204, and then is sent to a transfer nip portion formed by a facing roller 105 and a transfer roller 122 as a transfer member.

Each of image forming units 111C, 112C, 113C, and 114C includes at least an image bearing member. Photosensitive drums 111, 112, 113, and 114 as image bearing members rotate in a counterclockwise direction illustrated in FIG. 1. In each image forming unit, an electrostatic latent image is sequentially formed on an outer circumferential surface of the photosensitive drum by laser light from a laser scanner 120. The electrostatic latent image is developed by a developing roller included in each image forming unit, and a toner image is formed. The toner images formed on the photosensitive drums 111, 112, 113, and 114 are transferred onto an intermediate transfer belt 130. When forming a color image, latent images for yellow, magenta, cyan, and black are developed on the photosensitive drums 111, 112, 113, and 114, respectively, and then toner images formed on the respective photosensitive drums are sequentially transferred onto the intermediate transfer belt 130. Then, the toner images formed on the intermediate transfer belt 130 are collectively transferred onto the sheet S which has been sent to the transfer nip portion formed by the facing roller 105 and the transfer roller 122. The intermediate transfer belt 130 rotates while being stretched by at least the facing roller 105 and a tension roller 121.

The sheet S with the toner images transferred thereon is sent to a fixing nip portion formed by a fixing film 107 and a pressure roller 108. When the sheet S is heated and pressurized at the fixing nip portion, the toner images are fixed onto the sheet S. The sheet S with the toner images fixed thereon is discharged out of the image forming apparatus 101 by discharge rollers 109 and 110.

<Configuration of Sheet Feeding Device>

The sheet feeding device 8 includes the feeding cassette 201. The feeding cassette 201 can be detachably attached to the image forming apparatus 101 from a front side of the apparatus (the side on which an operator operates the image forming apparatus 101, i.e., the right-hand side of the image forming apparatus 101 illustrated in FIG. 1), allowing a user to easily place sheets and treat jam. The feeding cassette 201 includes a cassette frame 207, a lift arm rotational axis 210, a sheet stacking member 209, and a lift arm 208.

Referring to FIG. 1, the sheet stacking member 209 can stack a plurality of sheets. The feeding roller 202 included in a feeding unit contacts and feeds an uppermost sheet of a plurality of sheets stacked on the sheet stacking member 209. The feed roller 203 (conveyance member) and a separation roller (separation member) 211 separate a sheet from the sheets fed by the feeding roller 202. A feeding guide 205 provided between the feeding roller 202 and the feed roller 203 guides the conveyance of the sheet S fed in the feeding direction by the feeding roller 202. After passing through a conveyance roller pair (rollers 250 and 252), the sheet S is conveyed to the transfer nip portion formed by the transfer roller 122 and the facing roller 105 via the intermediate transfer belt 130.

The dotted line portion illustrated in FIG. 1 illustrates the sheet feeding device 8 according to the present embodiment. As illustrated in FIG. 1, according to the present embodiment, the sheet feeding device 8 is a part of an apparatus main body of the image forming apparatus 101 and includes at least the feeding roller 202, the feed roller 203, and the conveyance facing roller 204.

Figure 2:
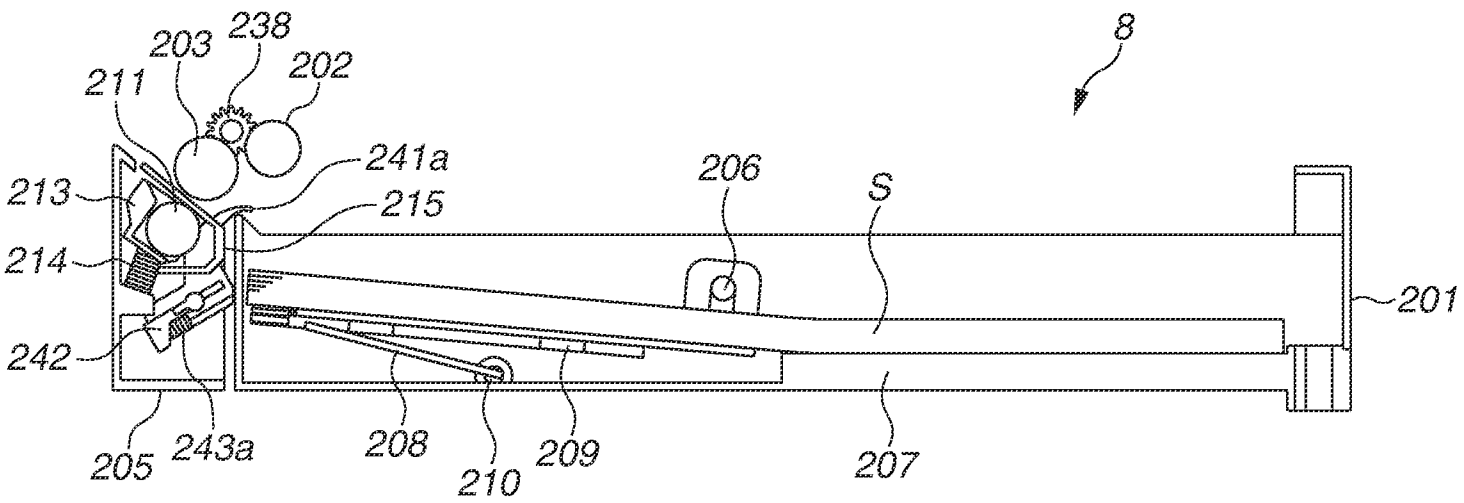
FIG. 2 is a cross-sectional view illustrating a sheet feeding device.

FIG. 2 is a schematic view illustrating an overall configuration of the sheet feeding device 8. A configuration for raising the sheet S to the feeding position will be described below with reference to FIG. 2. The feeding cassette 201 includes the cassette frame 207, the sheet stacking member 209 that is swingable (sheet stacking unit) attached to the cassette frame 207, and the lift arm 208 for raising the sheet stacking member 209. The feeding cassette 201 is inserted into the apparatus main body from the front side of the apparatus. After the insertion, the driving force is transmitted to the lift arm 208 to raise the sheets S stacked in the feeding cassette 201 up to a feedable position. When the lift arm 208 rotates centering on a lift arm rotational axis 210, the sheet stacking member 209 stacking the sheets S rotates centering on a sheet stacking member rotational axis 206.

Figure 3:
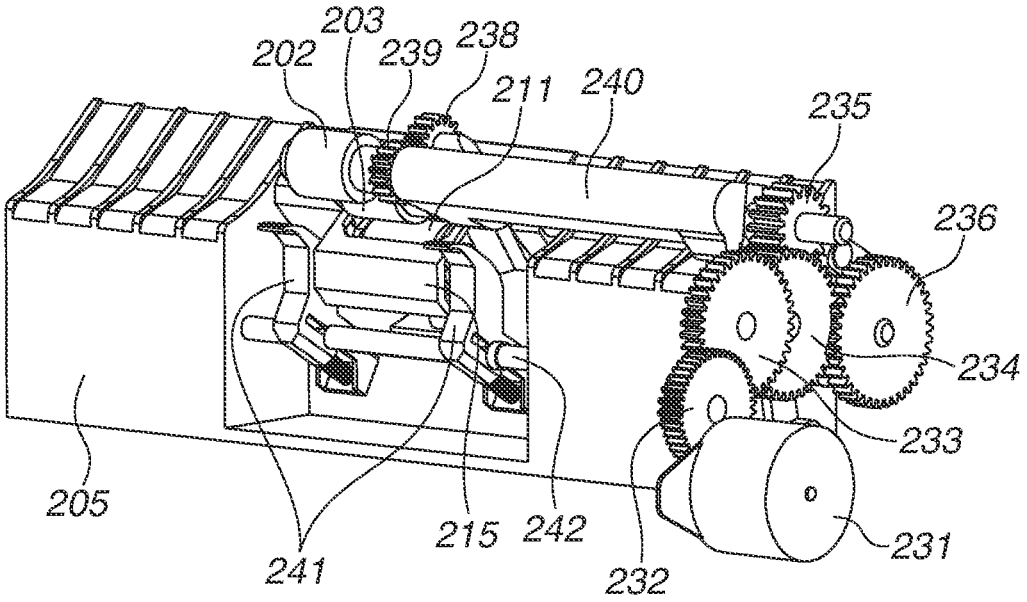
FIG. 3 is a perspective view illustrating a part of a sheet feeding device according to a first embodiment.
Figure 4:
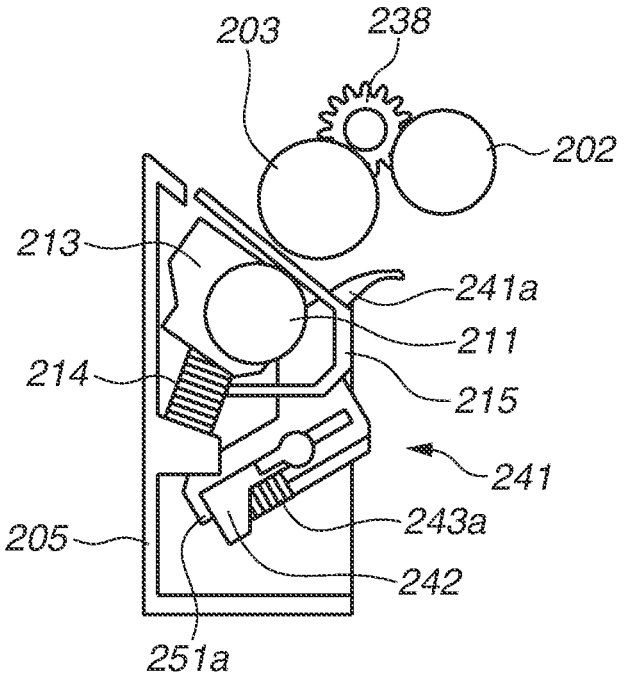
FIG. 4 is a cross-sectional view illustrating a part of the sheet feeding device according to the first embodiment.

FIG. 3 is a perspective view illustrating a part of the sheet feeding device 8. FIG. 4 is a cross-sectional view illustrating a part of the sheet feeding device 8. The separation roller 211 is attached to the feeding guide 205 via a separation roller holder 213 and a separation roller spring 214, and is urged toward the feed roller 203 by the separation roller spring 214. A separation nip guide 215 is provided to allow the sheet S fed by the feeding roller 202 to smoothly enter the nip portion formed by the separation roller 211 and the feed roller 203.

Although, in the present disclosure, the separation roller 211 is provided as a separation member, the separation member is not limited to the separation roller 211. A separation pad or a retarded roller can be used as a separation member. More specifically, a separation member according to the present disclosure needs to, when a plurality of sheets is fed together, separate a sheet from the fed sheets.

<Drive Configuration of Sheet Feeding Device>

Figure 5A:
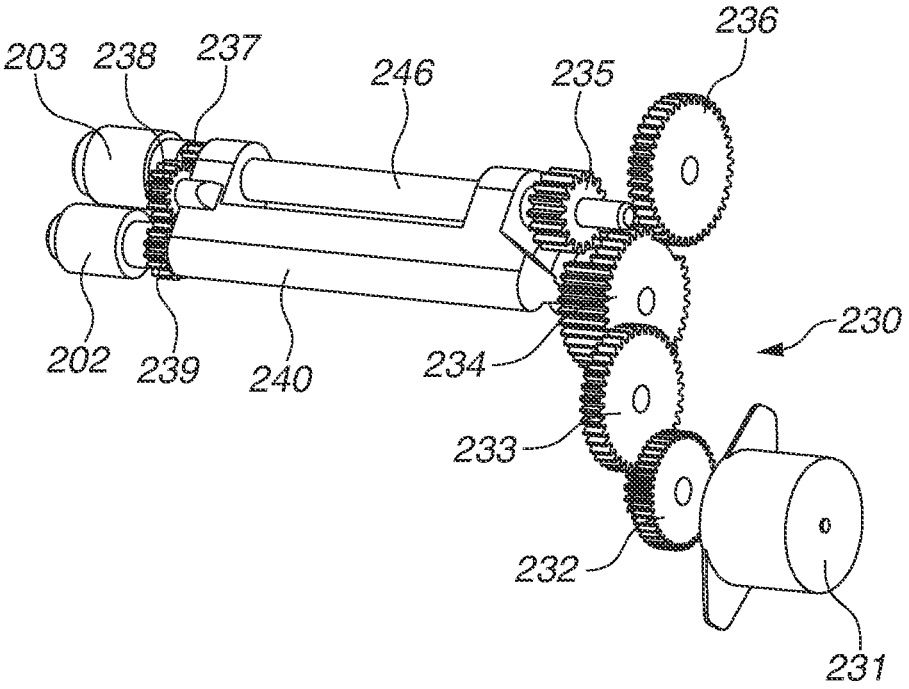
FIG. 5A is a perspective view illustrating a drive transmission unit when viewed from a drive source side.
Figure 5B:
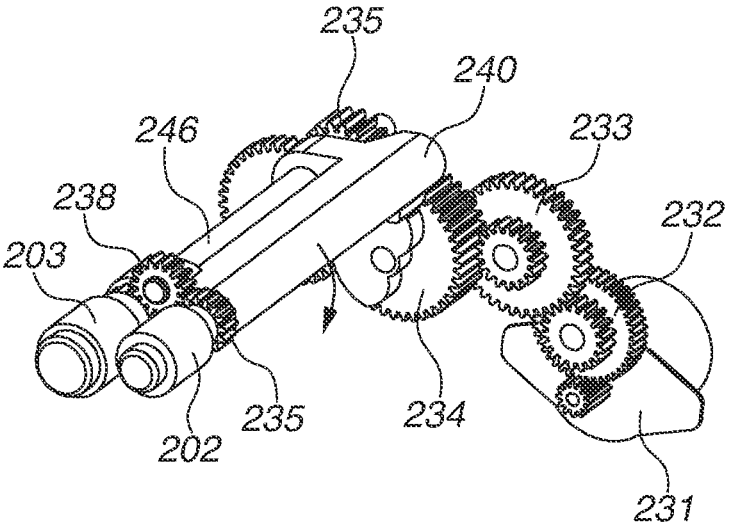
FIG. 5B is a perspective view illustrating the drive transmission unit when viewed from a side opposite to the side illustrated in FIG. 5A.

A drive transmission unit of the sheet feeding device 8 will be described below with reference to FIGS. 5A and 5B. FIG. 5A is a perspective view illustrating the drive transmission unit when viewed from a drive source 231. FIG. 5B is a perspective view illustrating the drive transmission unit when viewed from a side opposite to the side illustrated in FIG. 5A. A drive transmission unit 230 as a drive unit of the sheet feeding device 8 transmits a driving force generated by the drive source 231 to the feed roller 203.

The drive transmission unit 230 includes a first drive gear 232, a second drive gear 233, and a partially-toothless gear 234. The partially-toothless gear 234 is regulated and deregulated in rotation by a solenoid (not illustrated) to selectively engage with the second drive gear 233. When the solenoid deregulates the rotation, the partially-toothless gear 234 engages with the second drive gear 233, and the driving force is transmitted to the partially-toothless gear 234. Then, the partially-toothless gear 234 starts rotating. The rotation of the partially-toothless gear 234 is transmitted to a feed drive gear 235. Then, a feed shaft 246, a feed gear 237, and the feed roller 203 rotate together with the feed drive gear 235.

When the rotation of the feed gear 237 rotates a pick gear 239 via an idler gear 238, the feeding roller 202 integrally provided with the pick gear 239 rotates. The partially-toothless gear 234 is provided with a cam member for rotating a pick roller separation member 240 centering on the feed roller 203. The cam member makes the conveyance roller 202 come in and out of contact with the sheets S stacked on the sheet stacking member 209. The partially-toothless gear 234 rotates once and the partially-toothless portion of the partially-toothless gear 234 faces the second drive gear 233. At this position, the solenoid regulates the partially-toothless gear 234 not to transmit the driving force.

The partially-toothless gear 234 engages with a separation/spacing gear 236 to transmit the driving force.

The separation roller 211 is disposed at a position facing the feed roller 203. The separation roller 211 is provided with a torque limiter mechanism with which the separation roller 211 is driven to rotate in the conveyance direction when applied with predetermine torque. The separation roller 211 is fixed to the separation roller holder 213 via the torque limiter mechanism. The separation roller holder 213 is urged toward the feed roller 203 by the separation roller spring 214. When the separation roller 211 comes in contact with the feed roller 203, the position of the separation roller holder 213 is settled.

<Spacing Unit for Separation Members>

Figure 6A:
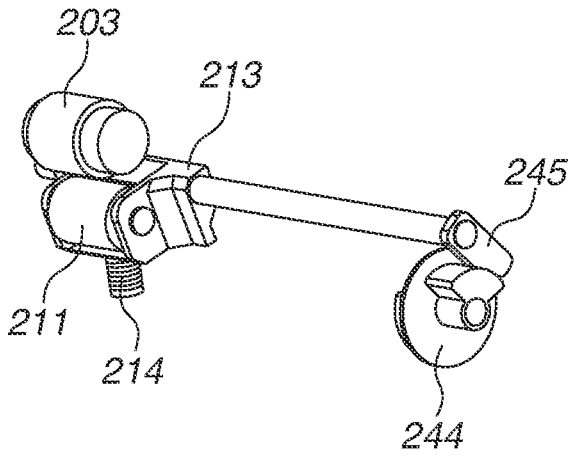
FIGS. 6A and 6B are perspective views illustrating a spacing unit.
Figure 6B:
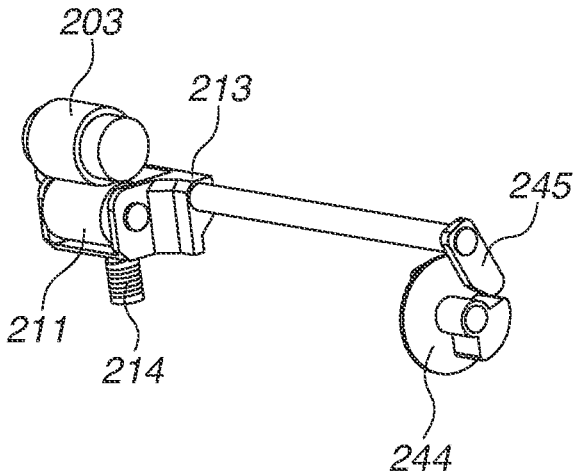

The spacing unit for moving the separation roller 211 will be described below. The separation roller 211 is disposed to be movable by the spacing unit between a contact position where the separation roller 211 contacts the feed roller 203 and a separation position where the separation roller 211 separates from the feed roller 203 to cancel a separation nip portion. In other words, the spacing unit can space the separation roller 211 from the feed roller 203 to cancel the separation nip portion formed by the separation roller 211 and the feed roller 203. The spacing unit for moving the separation roller 211 between the contact position and the separation position will be described below with reference to FIGS. 6A and 6B. The spacing unit includes at least the separation/spacing gear 236 and a separation cam 244. The separation cam 244 (spacing cam) is coaxially disposed with the separation/spacing gear 236 to rotate together with the separation/spacing gear 236.

When the separation/spacing gear 236 is rotated by the partially-toothless gear 234, a lever member 245 rotates along the cam surface of the separation cam 244 by the force of the separation roller spring 214 urging the separation roller holder 213 toward the feed roller 203. When the level member 245 rotates by a predetermined amount, the separation roller 211 contacts the feed roller 203, and the position of the separation roller holder 213 is settled (in a state illustrated in FIG. 6B). When the separation/spacing gear 236 is further rotated, the lever member 245 is raised along the cam surface of the separation cam 244, and the separation roller 211 separates from the feed roller 203 (in a state illustrated in FIG. 6A).

<Moving Unit>

Return levers 241 as a moving unit contacting the sheet S to move the sheet S to an upstream side in the sheet feeding direction will be described below with reference to FIGS. 7A, 7B, 8, 9, 10A, 10B, and 11.

Figure 7A:
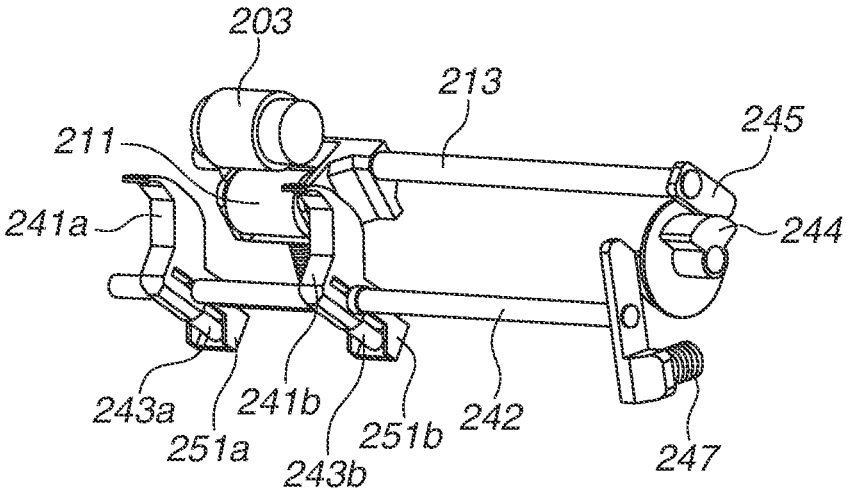
FIG. 7A is perspective view illustrating a separation unit when viewed from a separation cam side.
Figure 7B:
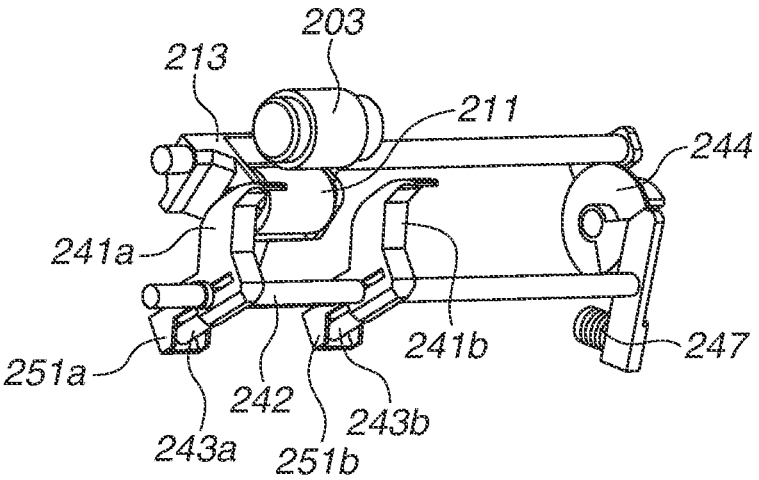
FIG. 7B is a perspective view illustrating the separation unit when viewed from a side opposite to the side illustrated in FIG. 7A.

FIG. 7A is a perspective view illustrating a peripheral portion of the separation roller 211 when viewed from the separation cam 244. FIG. 7B is a perspective view illustrating a peripheral portion of the separation roller 211 when viewed from a side opposite to the side illustrated in FIG. 7A. FIGS. 7A and 7B illustrate a position of the return levers 241 in a state where the separation roller 211 is positioned at the separation position illustrated in FIG. 6A.

Positions of the return levers 241 respectively illustrated in FIGS. 7A and 7B indicate a waiting position at which the sheet S coming from the feeding cassette 201 is prevented from entering the separation nip portion. The return levers 241 include at least two levers. According to the present embodiment, the return levers 241 include a first return lever 241*a* as a first moving member and a second return lever 241*b* as a second moving member. The moving unit 241 is provided with a supporting member 242 as a supporting member for supporting the first return lever 241*a* and the second return lever 241*b*. The moving unit 241 is provided with a lever spring 243*a* as a first urging member for urging the first return lever 241*a*, and a lever spring 243*b* as a second urging member for urging the second return lever 241*b*.

Figure 8:
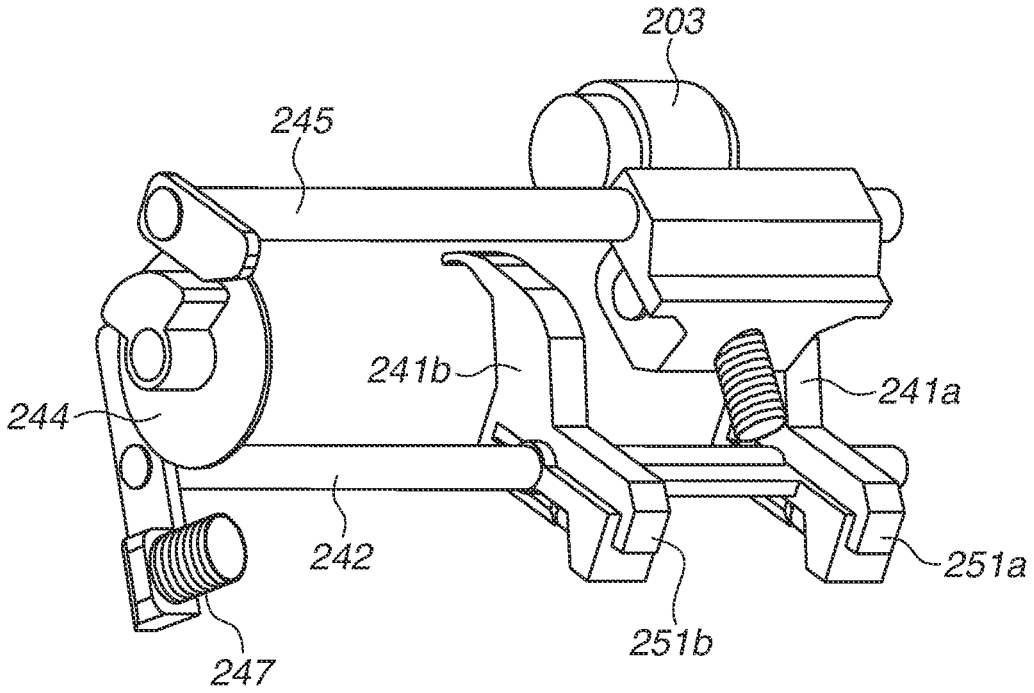
FIG. 8 is a perspective view illustrating a configuration of a moving unit according to the first embodiment.

The first return lever 241*a* and the second return lever 241*b* are upwardly urged as illustrated in FIG. 7A by the lever springs 243*a* and 243*b*, and are positioned by stopper members 251*a* and 251*b*, respectively. FIG. 8 is a perspective view illustrating the stopper members 251*a* and 251*b*. As illustrated in FIGS. 3 and 8, the stopper member 251*a* is disposed at the first return lever 241*a*. When the supporting member 242 and the stopper member 251*a* contact each other by an urging force of the lever spring 243*a*, the first return lever 241*a* is positioned. The stopper member 251*b* and the second return lever 241*b* have a similar relation. In this configuration, each of the first return lever 241*a* and the second return lever 241*b* according to the present embodiment can independently thrust-move with respect to the supporting member 242. The supporting member 242 is urged along the separation cam 244 by a lever cam spring 247 as an urging spring for supporting. The supporting member 242 is configured to move in association with the rotation of the separation cam 244.

Figure 9:
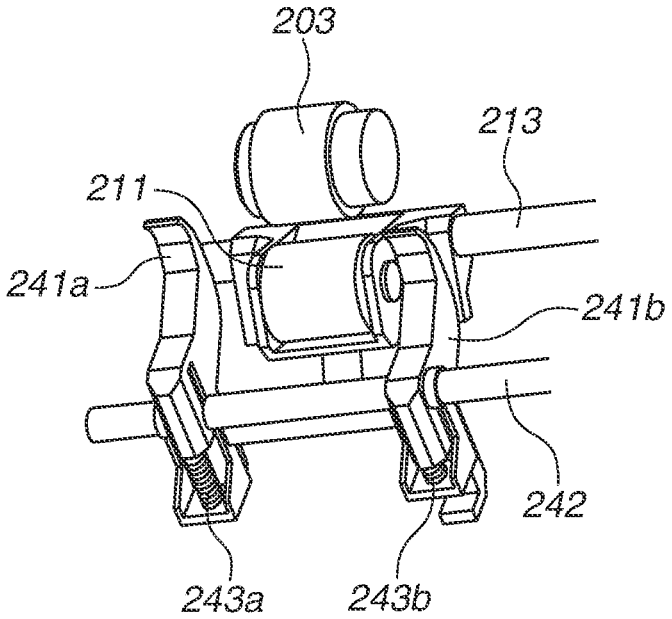
FIG. 9 is a perspective view illustrating a configuration of moving members included in the moving unit according to the first embodiment.

FIG. 9 is a perspective view illustrating a state where each of the first return lever 241*a* and the second return lever 241*b* according to the present embodiment has independently moved with respect to the supporting member 242. As illustrated in FIG. 9, when the lever spring 243*b* is compressed to a further extent than the lever spring 243*a*, the second return lever 241*b* moves independently of the first return lever 241*a*.

Figure 10A:
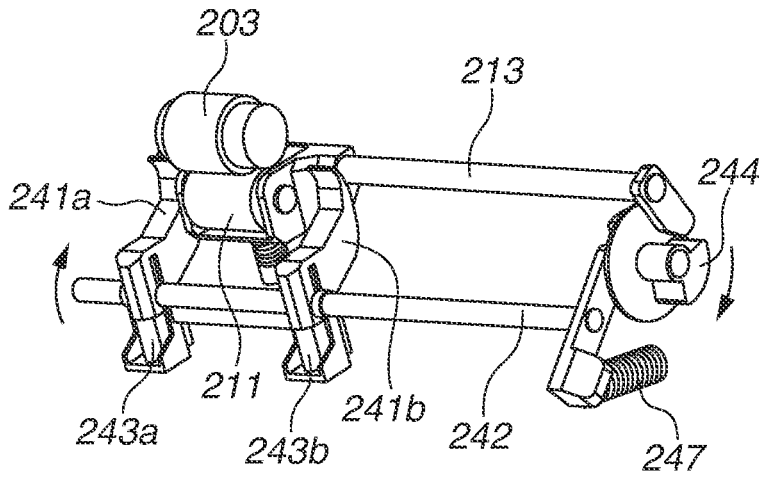
FIG. 10A is perspective view illustrating the separation unit when viewed from a separation cam side.
Figure 10B:
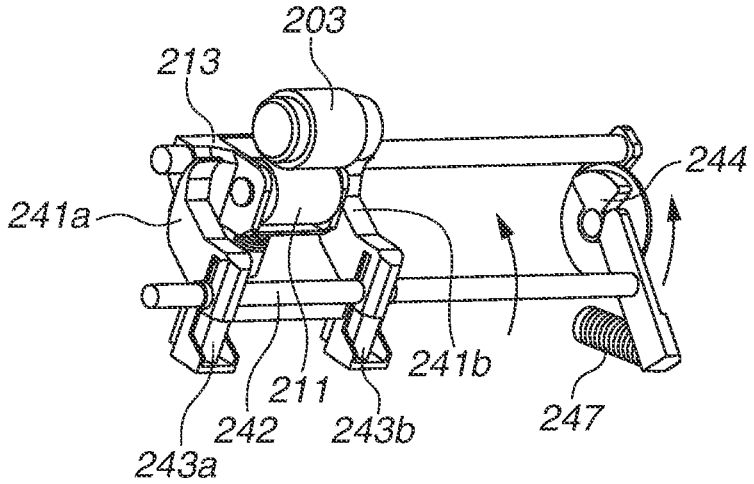
FIG. 10B is a perspective view illustrating the separation unit when viewed from a side opposite to the side illustrated in FIG. 10A.

FIG. 10A is a perspective view illustrating a peripheral portion of the separation roller 211 when viewed from the separation cam 244. FIG. 10B is a perspective view illustrating a peripheral portion of the separation roller 211 when viewed from a side opposite to the side illustrated in FIG. 10A. FIGS. 10A and 10B illustrate a position of the return levers 241 in a state where the separation roller 211 is positioned at the contact position illustrated in FIG. 6B. The position of the return levers 241 illustrated in FIGS. 10A and 10B indicates a retreating position where the return levers 241 are retreated from the sheet conveyance path not to prevent the sheet S conveyed from the feeding cassette 201 from entering the separation nip portion. When the separation cam 244 is rotated by the drive transmission unit 230, the supporting member 242 rotates in a retreating direction by the spring force of the lever cam spring 247, resulting in the states illustrated in FIGS. 10A and 10B. When the separation cam 244 further rotates and completes one rotation, the return levers 241 return to a waiting state (illustrated in FIGS. 7A and 7B) where the return levers 241 protrude into the sheet conveyance path.

Figure 11A:
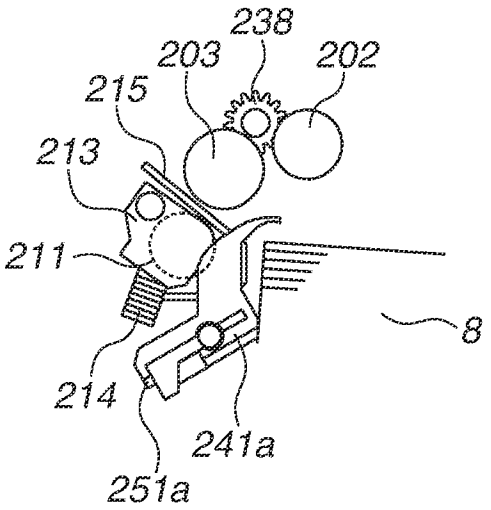
FIGS. 11A, 11B, and 11C are cross-sectional views illustrating the moving unit.
Figure 11B:
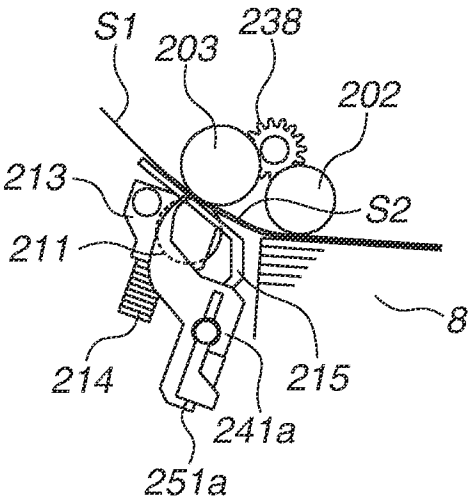
Figure 11C:
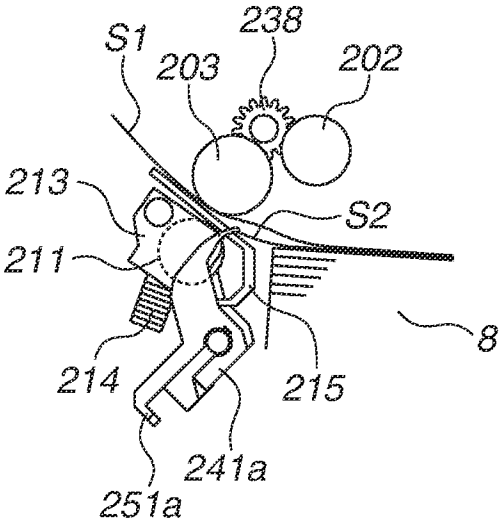

A relation between the state of the moving unit 241 and the sheet S will be described below with reference to FIGS. 11A to 11C. FIGS. 11A to 11C are cross-sectional views illustrating the movement of the first return lever 241*a* configuring the moving unit 241. FIG. 11A illustrates the waiting state immediately before the sheet S is fed. In the waiting state, the first return lever 241*a* protrudes to prevent the sheet S from entering the separation nip portion. A sheet-passing state illustrated in FIG. 11B indicates a sheet conveyance state. In this state, the conveyance sheet S is conveyed and the following conveyance sheet S2 is separated by the separation roller 211. At this timing, the return levers 241 retreat to a position not to disturb the sheet conveyance. In a returning state illustrated in FIG. 11C, the first return lever 241*a* is moving back the following conveyance sheet S2 toward the feeding cassette 201 in synchronization with a timing when the separation roller 211 separates from the feed roller 203. Here, the moving unit 241 is movable to a waiting position where the first return lever 241*a* and the second return lever 241*b* wait as moving members and remain available in a protruding state toward the upstream side in the feeding direction from the separation nip portion. Also, the moving unit 241 is movable to a retreating position where the first return lever 241*a* and the second return lever 241*b* are retreated as withdrawn from a direction of sheet feeding by the feeding unit having the feeding roller 202.

In a case where the following conveyance sheet S2 is not deformed (curled) or deformed not so much in a width direction perpendicularly intersecting with a sheet conveyance direction, the second return lever 241*b* follows the first return lever 241*a* to trace a similar moving path to the moving path of the first return lever 241*a* illustrated in FIGS. 11A to 11C.

In a case where the sheet S2 is deformed (curled) in the sheet width direction, the return lever 241 on one side pressed by the sheet S2 returns the sheet S2, and therefore a gap may arise between the sheet S on the other side and the return lever 241. In this case, the following conveyance sheet S2 needs to be moved back only by the return lever 241 on one side, and therefore cannot be applied with a sufficient return force. This results in a case that the following conveyance sheet S2 enters the separation nip portion.

Figure 12A:
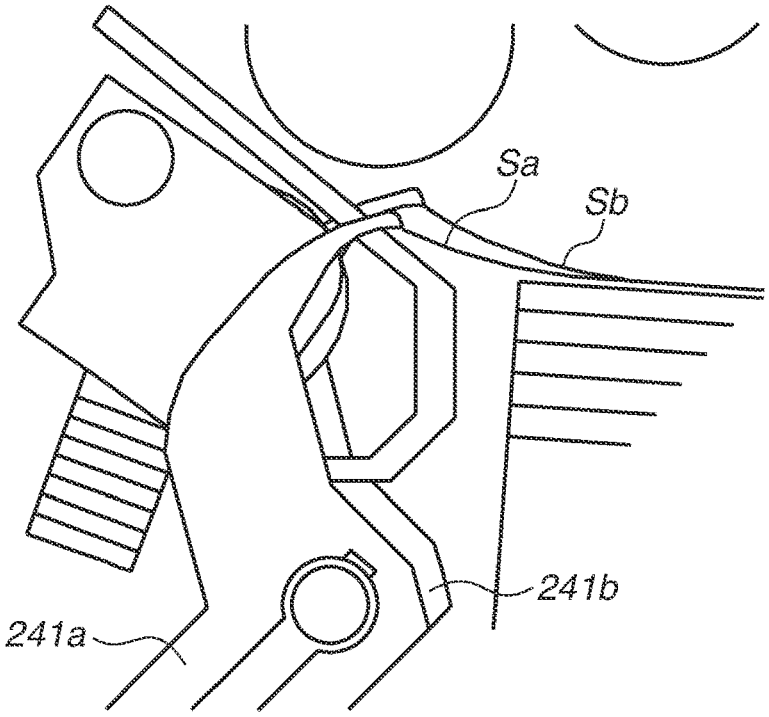
FIG. 12A is a cross-sectional view illustrating a relation between a sheet and each moving member.
Figure 12B:
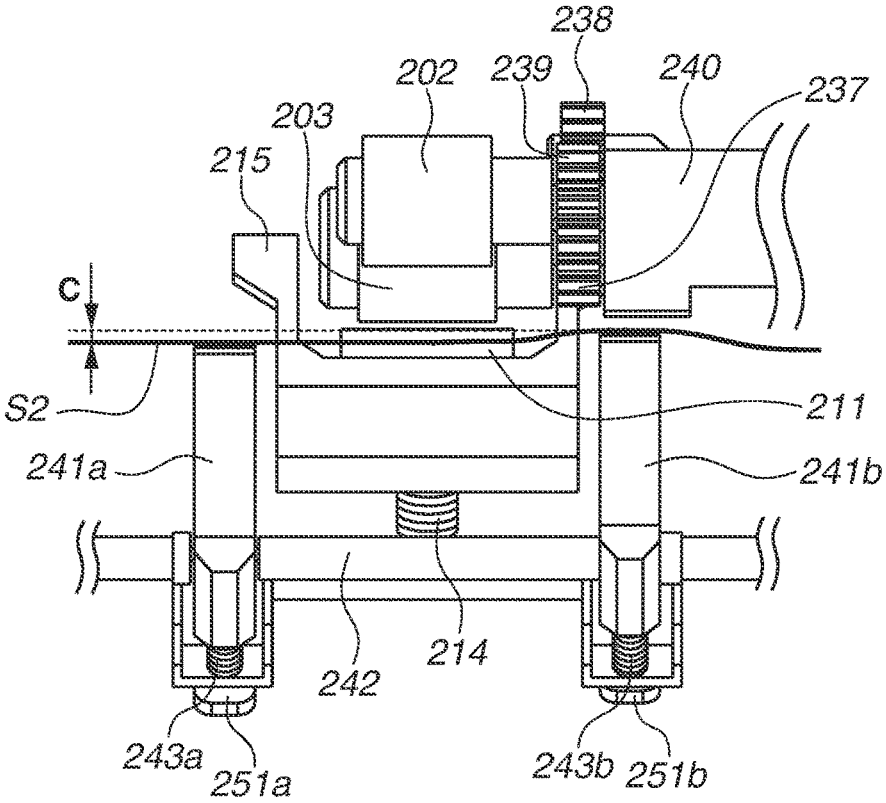
FIG. 12B is a front view illustrating a relation between the sheet and the each moving member.

However, in the configuration according to the present embodiment, the first return lever 241*a* and the second return lever 241*b* can independently thrust-move as described above. For example, when pressed by the sheet S2, the first return lever 241*a* can be pushed forcibly by the sheet S2 so as to be driven by the sheet S2 with force to advance from one position to another position without being influenced by the second return lever 241*b* or movement of the second return lever 241*b*. FIGS. 12A and 12B are cross-sectional views illustrating states where the sheet on the side of the second return lever 241*b* is more largely curled than the sheet on the side of the first return lever 241*a*. As illustrated in FIG. 12A, in a case where the sheet on the side of the second return lever 241*b* has a large amount of curl toward the feed roller 203, the second return lever 241*b* more upwardly protrudes than the first return lever 241*a* where the sheet has a small amount of curl.

In the configuration according to the present embodiment, the first return lever 241*a* and the second return lever 241*b* thrust-move in a direction perpendicularly intersecting with the sheet conveyance direction (approximated perpendicular direction). This configuration allows maintaining the sheet contact position of the first return lever 241*a* and the second return lever 241*b* in the sheet conveyance direction to approximately the same position.

FIG. 12B is a cross-sectional view illustrating the state illustrated in FIG. 12A when viewed from the sheet conveyance direction. As illustrated in FIG. 12B, even when there is a difference (distance c) between the amounts of curl on the right and left sides of the sheet in the width direction perpendicularly intersecting with the sheet conveyance direction, each of the first return lever 241*a* and the second return lever 241*b* independently provided on the right and left sides follows the sheet S. As a result, in the configuration of the moving unit 241 according to the present embodiment, the first return lever 241*a* and the second return lever 241*b* can follow the deformation of the sheet S in the width direction to stably move back the following conveyance sheet S toward the feeding cassette 201.

A second embodiment of the present disclosure will be described below. The second embodiment will be described below centering on a configuration in which a moving unit 261 is provided with a first return lever 261*a* and a second return lever 261*b* which circularly move. The present embodiment is similar to the first embodiment except for components of the moving unit 261. Similar components are assigned the same reference numerals as those in the first embodiment.

Figure 13:
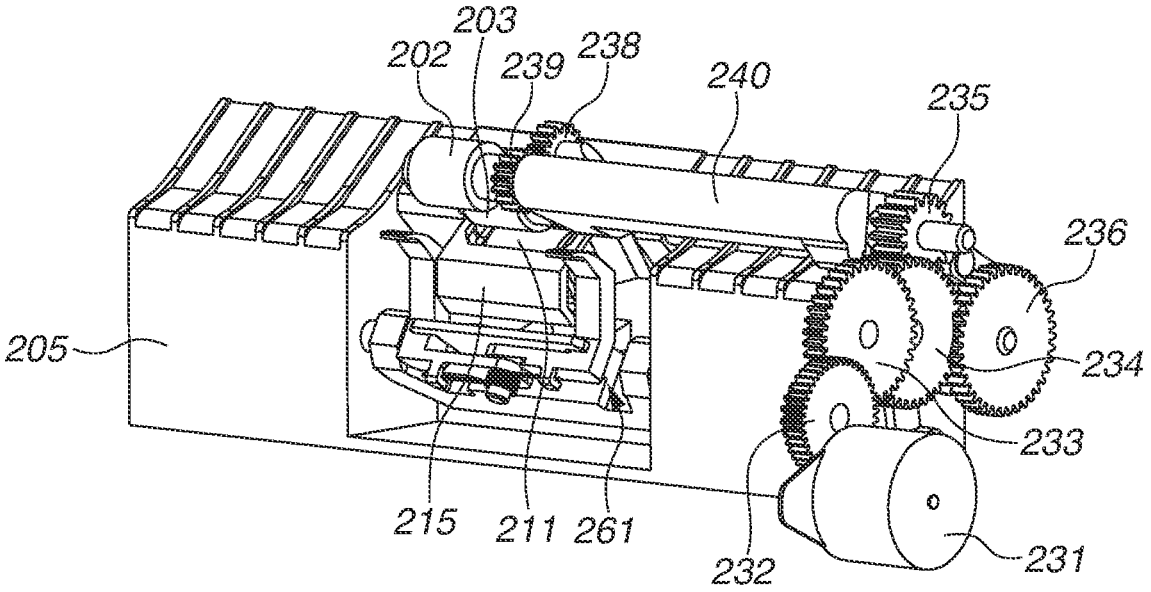
FIG. 13 is a perspective view illustrating a part of a sheet feeding device according to a second embodiment.
Figure 14:
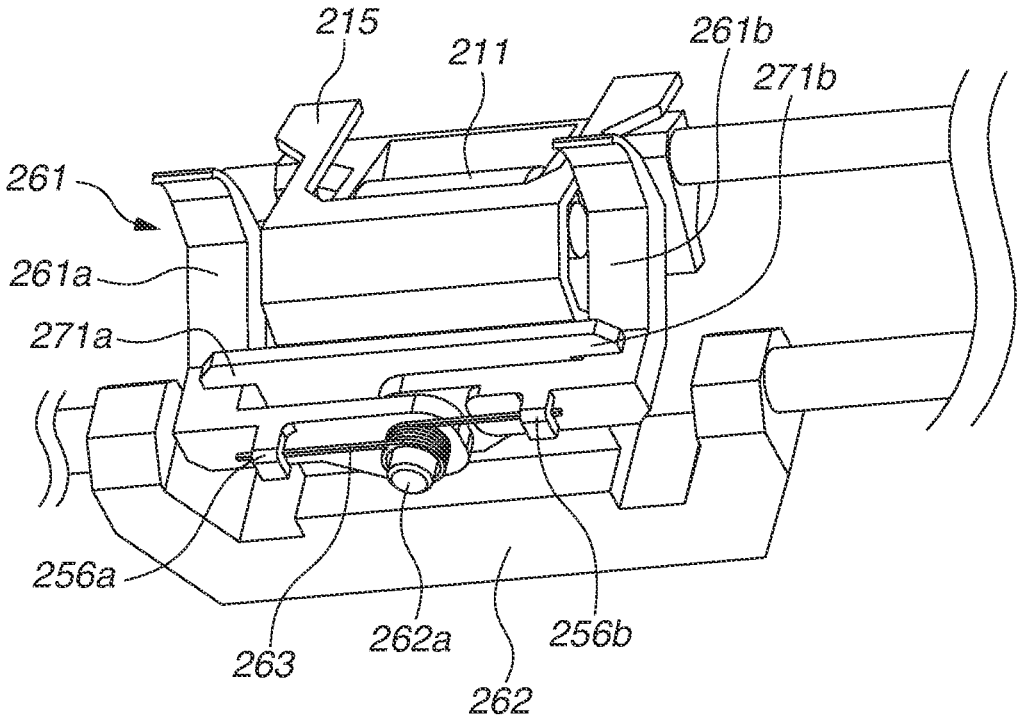
FIG. 14 is a perspective view illustrating a configuration of a moving unit according to the second embodiment.

FIG. 13 is a perspective view illustrating an entire outer appearance of a sheet feeding device according to the second embodiment. FIG. 14 is an enlarged perspective view illustrating the moving unit 261. The moving unit 261 includes at least two return levers. More specifically, the first return lever 261*a* and the second return lever 261*b* are rotatably attached centering on a rotational axis 262*a* provided on a supporting member 262.

When a return lever spring 263 as a common urging member presses a first return lever spring fixing member 256*a* and a second return lever spring fixing member 256*b*, the first return lever 261*a* and the second return lever 261*b* are urged toward the feeding cassette 201, and then contact the stopper members 271*a* and 271*b*, respectively, thus settling the position in the waiting state. When the first return lever 261*a* and the second return lever 261*b* are applied with a force in a direction opposite to the urging direction of the return lever spring 263, the first return lever 261*a* and the second return lever 261*b* independently move to the retreating position centering on the rotational axis 262*a*.

Figure 15A:
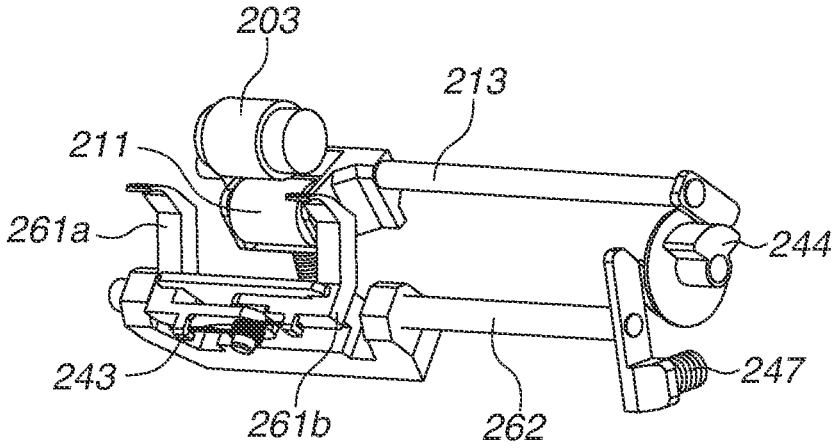
FIGS. 15A and 15B are perspective views illustrating a configuration of the moving unit according to the second embodiment.
Figure 15B:
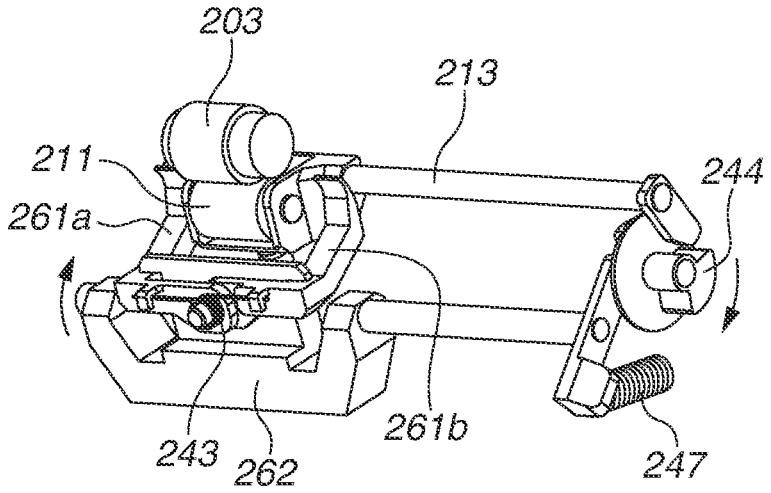

FIG. 15A illustrates a peripheral portion of the separation roller 211 in the waiting state. The separation roller 211 is in the separation state, and the return levers 261 are positioned to prevent the conveyance of the sheet S from the feeding cassette 201. FIG. 15B illustrates a state where the separation roller 211 contacts the feed roller 203, and the return levers 261 are retreated.

Figure 16:
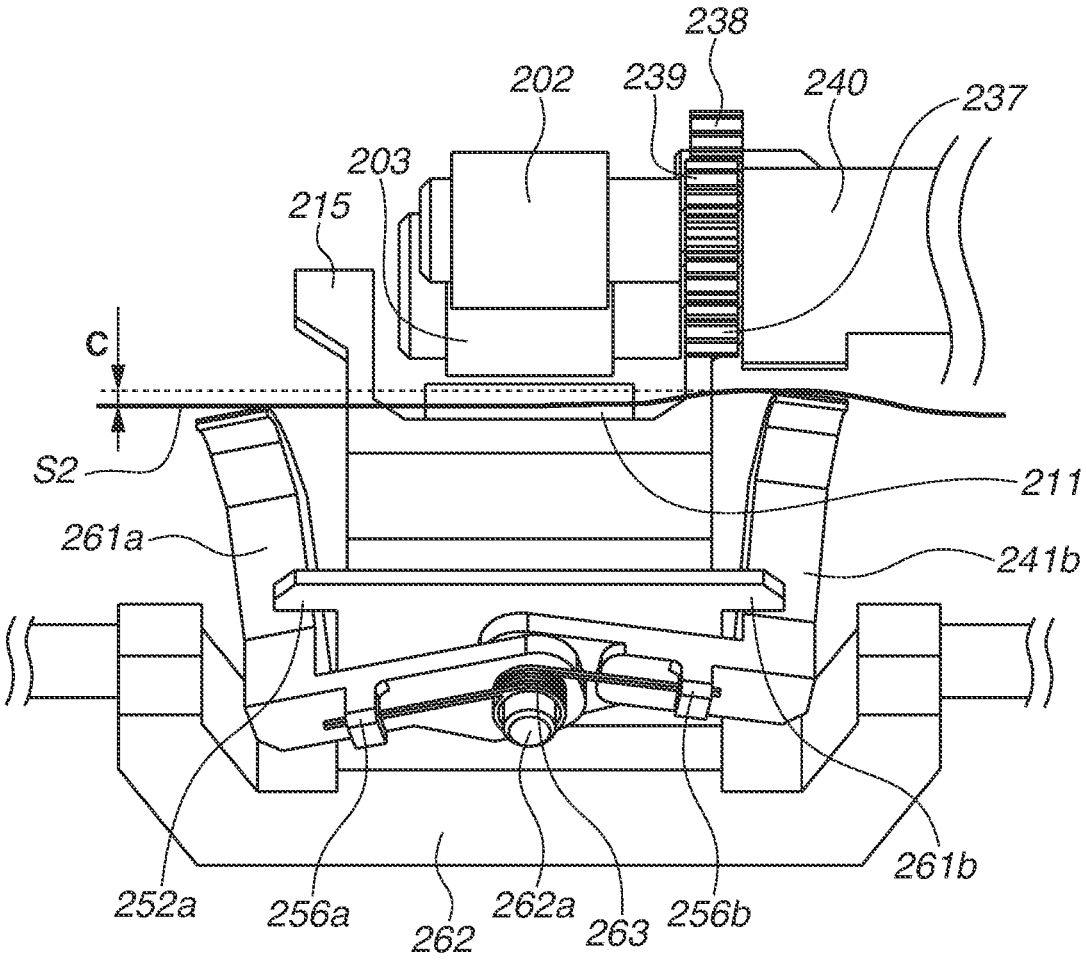
FIG. 16 is a front view illustrating a relation between a sheet and each moving member.

In the moving unit 261, the first return lever 261*a* and the second return lever 261*b* rotate centering on the rotational axis 262*a*. As a result, as illustrated in FIG. 16, even when there is a difference (distance c) between the amounts of curl on the right and left sides of the sheet S, each of the first return lever 261*a* and the second return lever 261*b* independently provided on the left and right sides, respectively, follows the sheet S. Therefore, similar to the first embodiment, the first return lever 261*a* and the second return lever 261*b* can follow the deformation of the sheet S in the width direction to stably move back the following conveyance sheet S toward the feeding cassette 201.

While the present disclosure has been described with reference to embodiments, it is to be understood that the disclosure is not limited to the disclosed embodiments. The scope of the following claims is to be accorded the broadest interpretation so as to encompass all such modifications and equivalent structures and functions.

This application claims the benefit of Japanese Patent Application No. 2017-252539, filed Dec. 27, 2017, which is hereby incorporated by reference herein in its entirety.

What is claimed is:

1. A sheet feeding device comprising:

a sheet stacking unit configured to stack a plurality of sheets;

a feeding unit having a feed roller configured to feed a sheet by rotating in contact with a sheet stacked on the sheet stacking unit, and having a first supporting member configured to support the feed roller, wherein, when feeding an uppermost sheet of the plurality of stacked sheets, the first supporting member moves the feed roller to a position where the feed roller contacts the uppermost sheet;

a separation unit configured to contact sheets fed by the feeding unit and separate a sheet from the fed sheets; and a moving unit including a first moving member, a second moving member, a second supporting member configured to support the first moving member and the second moving member, a first urging member configured to change a distance between the second supporting member and a distal end of the first moving member, and a second urging member configured to change a distance between the second supporting member and a distal end of the second moving member, wherein the moving unit moves a sheet contacting the first and the second moving members to a position upstream of the separation unit in a feeding direction, wherein the first moving member is allowed to move against an urging force of the first urging member with respect to the second supporting member when pressed by a sheet, and wherein the second moving member is allowed to move against an urging force of the second urging member with respect to the second supporting member when pressed by a sheet.

2. The sheet feeding device according to claim 1, wherein the moving unit moves the first moving member and the second moving member independently of each other such that the distal end of the second moving member is higher than the distal end of the first moving member.

3. The sheet feeding device according to claim 1, wherein the first moving member includes a first abutting member configured to abut the first supporting member by the urging force of the first urging member, wherein the second moving member includes a second abutting member configured to abut the second supporting member by the urging force of the second urging member, and wherein the first moving member is positioned to the first supporting member when the first abutting member abuts the first supporting member, and the second moving member is positioned to the second supporting member when the second abutting member abuts the supporting member.

4. The sheet feeding device according to claim 1, wherein the moving unit includes a moving unit supporting member configured to rotatably support the first and the second moving members centering on a rotational axis, and wherein the first and the second moving members are independently movable with respect to the moving unit supporting member.

5. The sheet feeding device according to claim 4, further comprising a common urging member configured to urge the first and the second moving members, wherein the moving unit supporting member includes a first abutting member configured to abut the first moving member urged by the common urging member and a second abutting member configured to abut the second moving member urged by the common urging member.

6. The sheet feeding device according to claim 1, further comprising a conveyance unit disposed to face the separation unit and configured to convey a sheet conveyed by the feeding unit, wherein the conveyance unit forms a separation nip portion for separating a sheet with the separation unit.

7. The sheet feeding device according to claim 6, wherein the moving unit is movable to a waiting position where the first and the second moving members wait in a protruding state toward an upstream side in the feeding direction from the separation nip portion and to a retreating position where the first and the second moving members are retreated from a direction of sheet feeding by the feeding unit.

8. The sheet feeding device according to claim 7, further comprising a spacing unit configured to space the separation unit from the conveyance unit to cancel the separation nip portion formed by the separation unit and the conveyance unit, wherein the spacing unit moves the moving unit in association with movement of the separation unit.

9. The sheet feeding device according to claim 8, wherein the spacing unit includes a separation roller configured to form the separation nip portion with a conveyance roller provided on the conveyance unit, and a separation cam configured to move the separation roller to a contact position where the separation nip portion is formed and to move the separation roller from the contact position to a spacing position where the separation roller is separated from the conveyance roller.

10. The sheet feeding device according to claim 9, wherein the moving unit moves via the separation cam.

11. An image forming apparatus comprising:

an image forming unit configured to form an image on a sheet; and the sheet feeding device according to claim 1, wherein the sheet feeding device is configured to feed a sheet to the image forming unit.

* * * * *